US007225781B2

(12) United States Patent
Tominaga et al.

(10) Patent No.: US 7,225,781 B2
(45) Date of Patent: Jun. 5, 2007

(54) METHODS FOR SURFACE TREATING ENGINE VALVES AND ENGINE VALVES TREATED THEREBY

(75) Inventors: Tadayoshi Tominaga, Aichi-ken (JP); Atsushi Taguchi, Aichi-ken (JP); Norimichi Fukaya, Aichi-ken (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/333,797

(22) Filed: Jan. 18, 2006

(65) Prior Publication Data

US 2006/0169239 A1 Aug. 3, 2006

(30) Foreign Application Priority Data

Jan. 28, 2005 (JP) ..... 2005-021318

(51) Int. Cl.
*F02N 3/00* (2006.01)
*B21K 1/22* (2006.01)

(52) U.S. Cl. ..... 123/188.3; 29/888.4

(58) Field of Classification Search ..... 123/188.3; 29/888.4
See application file for complete search history.

(56) References Cited

FOREIGN PATENT DOCUMENTS

| | | |
|---|---|---|
| JP | 01-096407 | 4/1989 |
| JP | 10-238320 | 9/1998 |

*Primary Examiner*—Noah P. Kamen
(74) *Attorney, Agent, or Firm*—Dennison, Schultz & MacDonald

(57) ABSTRACT

The present invention teaches a method for surface treating an engine valve made from titanium or titanium alloy in order to form a hardened coating having a high level of adhesion to the surface of the engine valve, and also having improved abrasion and impact resistances. The method includes a hardening treatment process for forming a hardened layer on the surface of the engine valve by providing oxygen dissolved into the surface of the engine valve as a solid solution; and a coating treatment process applied after the hardening treatment process. The coating treatment process forms a coating on the surface of the engine valve by physical vapor deposition.

8 Claims, 2 Drawing Sheets

METHODS FOR SURFACE TREATING ENGINE VALVES AND ENGINE VALVES TREATED THEREBY

This application claims priority to Japanese patent application serial number 2005-21318, the contents of which are incorporated herein by reference.

BACKGROUND OF THE INVENTION

1. Technical Field

The present invention relates to methods for surface treating an engine valve made from titanium or titanium alloy in order to improve abrasion and impact resistances, and also to engine valves treated by such methods.

2. Description of the Related Art

Engine valves, which are used for opening or closing intake and exhaust paths of an automobile or a motorcycle engine, are strongly required to have seizure resistance, abrasion resistance, impact resistance, and the like, because the engine valves are used in a harsh environment. Thus, various techniques have conventionally been proposed that apply several coating methods to a surface of an engine valve made from titanium or titanium alloy, so as to form a hardened coating for surface protection. For example, Japanese Laid-Open Publication No. 10-238320 discloses a titanium alloy engine valve coated with a CrN coating by a physical vapor deposition (PVD) process. Japanese Laid-Open Publication No. 1-96407 discloses a titanium alloy engine valve coated with a nickel alloy coating by an electroless plating process.

Forming such a coating on the surface of an engine valve may improve the abrasion resistance at a stem or a stem end portion of the engine valve. Especially in the case of a coating treatment by the PVD process, since the PVD process enables the coating to be extremely high in hardness, an engine valve coated by the PVD process may be drastically improved in abrasion resistance.

However, a coating formed by the PVD process is insufficient in impact resistance, although excellent in abrasion resistance. Thus, the extremely high hardness of the PVD coating on one hand results in drastically improving the abrasion resistance, but on the other hand results in poor adhesion between the coating and the substrate of the coating target. This is why an impact may cause the coating to be peeled off from the substrate.

SUMMARY OF THE INVENTION

It is one object of the present invention to teach a method for surface treating an engine valve made from titanium or titanium alloy in order to form a hardened coating having a high level of adhesion with the surface of the engine valve, and also having improved abrasion and impact resistances. "Titanium or titanium alloy" herein may be titanium alone or titanium alloyed with other metals. Thus, a metal surface treated in the present invention can not only be titanium alone (e.g. a high purity titanium referred to as classes 1 to 4 in the JIS (Japan Industrial Standards)), but also titanium alloy including Ti-6Al-4V, Ti-6Al-2Sn-4Zr-2Mo, Ti-3Al-2.5V, or Ti-6Al-2Sn-4Zr-6Mo.

The present inventors have found that an engine valve is improved both in abrasion and impact resistances when a hardened layer is formed on the surface of the engine valve by furnishing the surface of the engine valve with oxygen as a solid solution and then forming a coating on the surface of the hardened layer with a PVD process. Thus, the inventors have achieved inventions having at least the following teachings.

According to one aspect of the present teachings, a method for surface treating an engine valve made from titanium or titanium alloy is taught that includes a hardening treatment process for forming a hardened layer on the surface of the engine valve by providing oxygen dissolved into the surface of the engine valve as a solid solution; and a coating treatment process applied after the hardening treatment process. The coating treatment process forms a coating on the surface of the engine valve by physical vapor deposition (PVD). The method may further include a removal process applied before the coating treatment process, wherein oxides or foreign materials, deposited on the surface of the hardened layer formed during the hardening treatment process, are removed. Also, during the removal process, the oxides or foreign materials deposited on the surface of the hardened layer may be removed with a shot peening treatment. Further, the coating formed during the coating treatment process may be a chromium nitride (CrN) coating. Still further, the method may further include a diamond-like carbon coating (DLC) process for forming a DLC coating by PVD on the surface of the previous coating formed during the previous coating treatment process.

According to another aspect of the present teachings, an engine valve made from titanium or titanium alloy is taught that includes a hardened layer on the surface of the engine valve, wherein the hardened layer is formed by providing oxygen dissolved into the surface of the engine valve as a solid solution, and the surface of the hardened layer is then coated with a coating formed by PVD, which may be a CrN coating. The surface of the coating formed by PVD may further be coated with a DLC coating also formed by PVD.

According to the present invention, it is possible to provide a method for surface treating an engine valve made from titanium or titanium alloy in order to form a hardened coating having high adhesion to the surface of the engine valve and also having improved abrasion and impact resistances, as well as to provide an engine valve treated by such methods.

BRIEF DESCRIPTION OF THE DRAWINGS

Additional objects, features and advantages of the present invention will be readily understood after reading the following detailed description together with the claims and the accompanying drawings, in which:

DETAILED DESCRIPTION OF THE INVENTION

Each of the additional features and teachings disclosed above and below may be utilized separately or in conjunction with other features and teachings to provide improved methods for surface treating an engine valve made from titanium or titanium alloy and an engine valve treated thereby. Representative examples of the present invention, which examples utilize many of these additional features and teachings both separately and in conjunction with one another, will now be described in detail. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
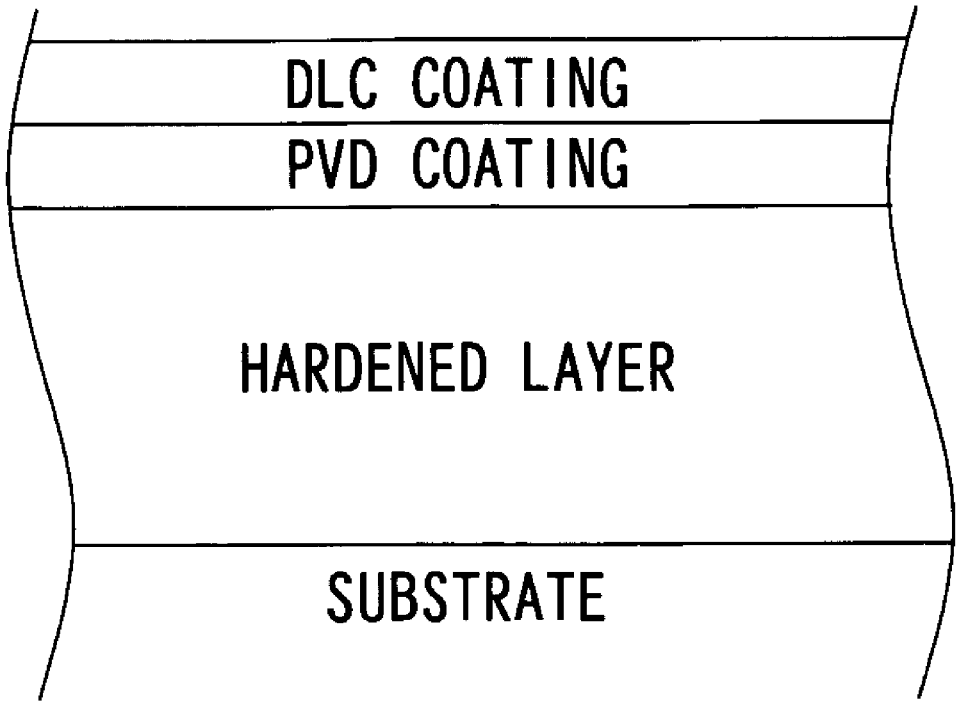
FIG. 1 is a sectional view schematically showing a near-surface region of an engine valve where a hardened layer, a PVD coating, and a DLC coating are formed.

An engine valve surface treated by a representative method of the present invention is made from titanium or titanium alloy. Referring now to FIG. 1, a near-surface region is shown that includes a hardened layer, a PVD coating, and a DLC coating. A "substrate" in FIG. 1 means an engine valve body that is a surface treatment target of the present invention. As shown in FIG. 1, the hardened layer is formed on the surface of the substrate. The PVD coating is formed on the hardened layer by a PVD process. The DLC coating is further formed on the PVD coating.

The representative surface treatment method is generally categorized into four processes. The first process is a "hardening treatment process" for forming a hardened layer on the surface of the engine valve by providing oxygen dissolved into the surface of the engine valve as a solid solution. Through the hardening treatment process, a hardened layer is formed that has a thickness in the range generally from 5 μm to 50 μm on the surface portion of the engine valve.

The second process is a "removal process" for removing oxides or foreign materials deposited on the surface of the hardened layer during the hardening treatment process. This process is applied as a pretreatment process of the coating process that will be described below.

The third process is a "coating treatment process" for coating the engine valve by a PVD process after the hardening treatment process. This coating treatment process forms a coating having a thickness in the range generally from 1 μm to 10 μm on the surface of the hardened layer containing oxygen as a solid solution. It should be noted that such a coating formed by a PVD process is referred to herein as a "PVD coating."

The fourth process is a "DLC treatment process" for forming a DLC coating by a further PVD process on the previous coating surface formed during the coating treatment process. This DLC treatment process forms a DLC coating having a thickness in the range generally from 1 μm to 10 μm on the surface of the PVD coating. As will be described in detail below, the "DLC coating" is referred to as a coating or a film made from carbons or metal-containing carbons that have an amorphous structure. The DLC coating is characterized not only by its high hardness but also by its low friction coefficient. The four processes will be described in detail below.

Hardening treatment process The hardening treatment process forms a hardened layer by providing oxygen dissolved into the surface of the engine valve as a solid solution so that the hardened layer contains oxygen as a solid solution. This process is achieved for example by allowing the engine valve to pass through the inside of a furnace that is maintained at atmospheric pressure in combination with a heating temperature generally between 650° C. and 850° C. It should be noted that such hardening treatment process for forming a hardened layer containing oxygen as a solid solution is well-known and disclosed for example in Japanese Laid-Open Publication No. 2001-301400. Also, the thickness of the hardened layer is adjustable by means of the heating temperature and the heating time.

Removal process The removal process removes oxides or foreign materials deposited on the surface of the hardened layer during the hardening treatment process, leaving the hardened layer formed on the surface of the substrate. Specifically, a removal technique such as a shot peening treatment may be applied in this process. According to the shot peening treatment, it is possible to only remove the coating-inhibiting materials, such as oxides or foreign materials, while leaving the hardened layer as it is. This treatment differs from a machining treatment such as grinding. When shot peening is applied, a shot peening apparatus may be used, for example, a compressed air blasting type. The shot peening apparatus may forcibly expel shot particles, which are made from metal powders or the like, against the surface of the hardened layer. This blasting treatment may remove foreign materials, titanium oxides, passivating films, and the like deposited on the surface of the hardened layer. Also, this treatment may simultaneously adjust the surface roughness of the hardened layer.

Control parameters used in the shot peening treatment may preferably include, but are not limited to, 100 m/second or more for an average shot particle velocity, and 100 μm or less for an average shot particle size. It is possible to adjust the shot peening time, for example, in the range from 2 seconds to 30 seconds. Also, shot particles to be blasted may be made, for example, from cast iron, steel, stainless steel, or the like.

Further, a lapping treatment such as an "Aero Lap" available from Yamashita Works Co., Ltd., Hyogo-ken, Japan, may be used as a removal technique. The Aero Lap is a removal or lapping technique where shot particles, which are resilient and tacky due to containing water therein, are blasted by air against the surface of the target. Since foreign materials, oxides, passivating films, and the like deposited on the surface of the hardened layer are removed by means of a removal process, a PVD coating adhesion to the surface of the hardened layer is improved.

Coating treatment process The coating treatment process further forms a PVD coating by a PVD process on the surface of the hardened layer formed on the engine valve surface.

PVD processes may include, but not are limited to, a vacuum deposition process, an ion plating process, an arc ion plating process, and a sputtering process. The vacuum deposition process is a process by which coating materials are evaporated into a vapor form by a heater or an electron beam, and then the vapor is deposited on the surface of the workpiece. The ion plating process is a process by which coating materials are evaporated so as to be ionized by passing through plasma, and then the ions of the coating materials are bombarded against the workpiece. The ion plating process evaporates metal and simultaneously introduces such reactant gas as nitrogen into the chamber including a workpiece so that nitride coatings are formed on the workpiece. The arc ion plating process is a process by which a target consisting of coating materials, to which a high negative potential is applied, is bombarded for example by argon ions so that the coating materials are sputtered on the workpiece. The ion plating process is preferably used as a PVD process of the present invention.

Coating materials used by a PVD process may include, but are not limited to, chromium nitride (CrN), titanium nitride (TiN), and titanium aluminum nitride (TiAlN). Of the coating materials, CrN is the most preferred since the CrN coating has a high adhesion strength. In order to form such a CrN coating, the aforementioned ion plating process is preferably used.

DLC treatment process The DLC treatment process further forms a DLC coating on the surface of the PVD coating formed during the previous coating treatment process. The DLC coating is specifically a coating of a film made from carbons or metal-containing carbons that have an amorphous structure. The coating typically includes a single- or multi-layered structure. Some typical examples of a DLC coating include an Me-DLC (Me-C:H) coating and a coating containing metal such as Si, Ti, Cr, W, or the like. The metal may relieve the stresses from the coating so as to provide the surface with a lower hardness but a higher adhesion. Also, a ta-C coating or a tetrahedral amorphous carbon coating is well known, and is formed by high density plasmas ionized from solid carbon sources so that the ta-C coating has a high hardness comparable to that of a diamond.

In the representative surface treatment method, some coating materials may be used by a DLC treatment process. Of such coating materials, a WC/C or tungsten carbide/carbon coating is the most preferred in the present invention. The WC/C coating is a coating that has a multi-layered structure. The multi-layered structure has alternately-deposited tungsten carbide layers and amorphous carbon layers, which generally have a thickness from a few nanometers to more than ten nanometers. The WC/C coating can be formed by a PVD coating process. More specifically, a workpiece or an engine valve is alternately coated with tungsten carbide layers and amorphous carbon layers by sputtering deposition while the workpiece or the engine valve is rotated within a chamber for the coating process.

As shown in FIG. 1, according to the aforementioned methods, an engine valve can be made that has a titanium or titanium alloy substrate having a hardened layer, a PVD coating, and a DLC coating sequentially formed on the surface. The substrate, the hardened layer, the PVD coating, and the DLC coating respectively have a Vickers hardness of Hv=200 to 400, 400 to 900, 900 to 3500, and 700 to 1800. Namely, the order of increasing hardness is: the substrate<the DLC coating<the hardened layer<the PVD coating.

If the hardened layer does not exist on the substrate, the PVD coating may undesirably be cracked or peeled off from the substrate surface when the substrate is dented or deformed under a local pressure applied to the surface. This is because the PVD coating is not as ductile as the substrate. However, the present invention allows the hardened layer to exist between the substrate and the PVD coating so that such cracking or peeling of the PVD coating can be prevented, because the hardened layer is harder and less ductile than the substrate. Thus, regardless of the extremely high hardness of the PVD coating, a high adhesion between the PVD coating and the substrate is maintained. Therefore, it is possible to highly improve the abrasion resistance of the engine valve and to avoid the peeling of the PVD coating due to impacts.

Further, the DLC coating is formed on the surface of the PVD coating. The DLC coating is characterized not only by its high hardness but also by its low friction coefficient. This has the effect of allowing engine components to have a longer life, because the abrasion resistance of the engine valve is improved so as to prevent damages of the corresponding components contacting the engine valve.

Figure 2:
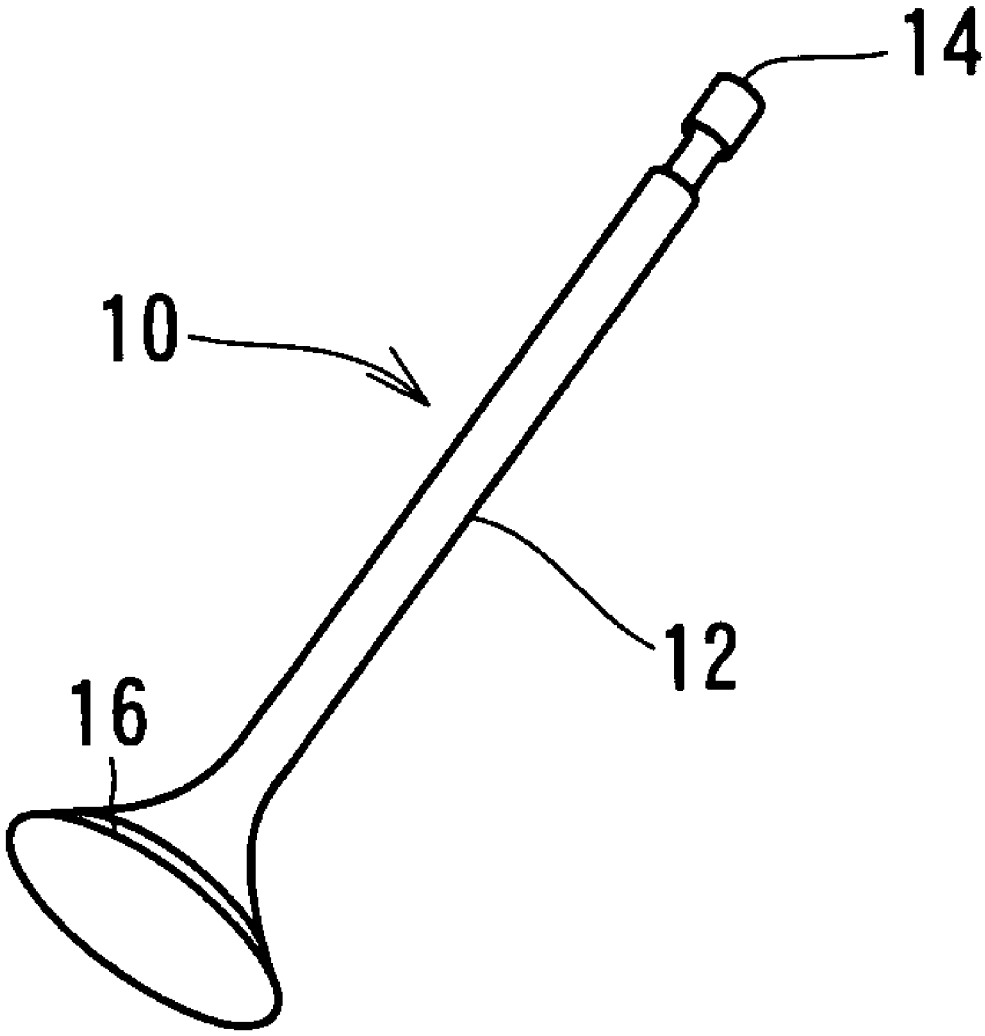
FIG. 2 is a perspective view of the engine valve.

It should be noted that the representative method for surface treating an engine valve may be applied to a portion of the surface of the engine valve, although it is preferable to be applied to the entire surface of the engine valve. For example, as shown in FIG. 2, the surface treatment may only be applied to a stem portion 12 or a stem end portion 14 of the engine valve 10, as well as to a valve seat face 16 thereof.

Although the representative method for surface treating an engine valve includes a hardening treatment process, a removal process, a coating treatment process, and a DLC treatment process, the removal process and the DLC treatment process of those processes may be omitted. It is possible to make an engine valve having improved abrasion and impact resistances even by only applying the hardening treatment process and the coating treatment process. However, it is preferable to further apply the removal process in order to make an engine valve having greatly improved abrasion and impact resistances.

What is claimed is:

1. A method for surface treating an engine valve made from titanium or titanium alloy, comprising:

a hardening treatment process for forming a hardened layer on a surface of the engine valve by providing oxygen dissolved into the surface of the engine valve as a solid solution; and a coating treatment process applied after the hardening treatment process, the coating treatment process forming a coating on the surface of the engine valve by physical vapor deposition.

2. The method as in claim 1, further comprising a removal process applied before the coating treatment process, wherein the removal process removes oxides or foreign materials deposited on the surface of the hardened layer formed during the hardening treatment process.

3. The method as in claim 2, wherein the removal process removes the oxides or the foreign materials deposited on the surface of the hardened layer with a shot peening treatment.

4. The method as in claim 1, wherein the coating formed during the coating treatment process is a chromium nitride coating.

5. The method as in claim 1, further comprising a diamond-like carbon treatment process for forming a diamond-like carbon coating by a physical vapor deposition on the surface of the coating formed during the coating treatment process.

6. An engine valve made from titanium or titanium alloy, comprising:

a hardened layer on the surface of the engine valve, wherein the hardened layer is formed by providing oxygen dissolved into the surface of the engine valve as a solid solution; and the surface of the hardened layer is coated with a coating formed by physical vapor deposition.

7. The engine valve as in claim 6, wherein the coating formed by physical vapor deposition is a chromium nitride coating.

8. The engine valve as in claim 6, wherein the surface of the coating formed by physical vapor deposition is further coated with a diamond-like carbon coating formed by physical vapor deposition.

* * * * *